US008049768B2

(12) United States Patent
Hagstrom

(10) Patent No.: US 8,049,768 B2
(45) Date of Patent: Nov. 1, 2011

(54) DISC OUTPUT STORAGE DRAWER FOR PROCESSOR

(75) Inventor: Erick Hagstrom, Medina, MN (US)

(73) Assignee: Primera Technology, Inc., Plymouth, MN (US)

( * ) Notice: Subject to any disclaimer, the term of this patent is extended or adjusted under 35 U.S.C. 154(b) by 1484 days.

(21) Appl. No.: 11/501,411

(22) Filed: Aug. 9, 2006

(65) Prior Publication Data

US 2008/0036844 A1 Feb. 14, 2008

(51) Int. Cl.
*B41J 2/315* (2006.01)

(52) U.S. Cl. ..... 347/171; 347/222; 347/197

(58) Field of Classification Search ..... 312/350, 312/334.27, 319.1, 319.2, 9.1, 9.9, 9.11, 312/9.12, 9.14, 9.26, 9.29, 9.31, 9.41, 9.48, 312/9.47, 9.57; 414/936; 248/429, 311.2, 248/312.1; 221/64, 65, 156, 312 R; 347/171, 347/193, 222, 197

See application file for complete search history.

(56) References Cited

U.S. PATENT DOCUMENTS

| | | | | |
|---|---|---|---|---|
| 5,478,144 | A * | 12/1995 | Bieck | 312/9.22 |
| 5,542,768 | A | 8/1996 | Rother et al. | 400/120.16 |
| 5,697,593 | A * | 12/1997 | Bieck | 248/311.2 |
| 6,021,029 | A | 2/2000 | Mamiya et al. | 360/133 |
| 6,141,298 | A | 10/2000 | Miller | 369/30 |
| 6,222,800 | B1 | 4/2001 | Miller et al. | 369/36 |
| 6,321,649 | B1 | 11/2001 | Vangen et al. | 101/35 |
| 6,332,680 | B1 | 12/2001 | Ozawa | 347/104 |
| 6,447,181 | B1 | 9/2002 | Hagstrom et al. | 400/120.01 |
| 6,580,444 | B1 | 6/2003 | Drynkin et al. | 347/171 |
| 6,760,052 | B2 | 7/2004 | Cummins et al. | 347/171 |
| 6,802,070 | B2 | 10/2004 | Britz et al. | 720/619 |

FOREIGN PATENT DOCUMENTS

EP 0 799 710 8/1997

* cited by examiner

*Primary Examiner* — Darnell Jayne
*Assistant Examiner* — Andrew Roersma
(74) *Attorney, Agent, or Firm* — Westman Champlin & Kelly, P.A.

(57) ABSTRACT

A disc processor such as a disc burner and printer, is provided in a housing. A drawer is slidably mounted on the bottom wall of the housing and is positionable in a retracted position in a recess with a portion underneath the processor and is slidably extendable from the processor. The disc output storage drawer carries ramps that will, when the disc output storage drawer is extended move to a position to provide a guide surface to guide a disc dropped thereon into a storage bin on the disc output storage drawer, and when the disc output storage drawer is in its retracted position, the ramps are automatically pivoted to a folded position and stored underneath the processor.

11 Claims, 11 Drawing Sheets

DISC OUTPUT STORAGE DRAWER FOR PROCESSOR

CROSS-REFERENCE TO RELATED APPLICATION

Reference is made to U.S. Pat. No. 6,760,052 entitled "CD RECORDER AND PRINTER," which illustrates a processor on which the present device can be used and which patent is incorporated by reference.

BACKGROUND OF THE INVENTION

The present invention relates to an extendable and retractable storage drawer that has guides for receiving finished processed substrates or discs, such as DVDs or CDs from a processor, and which, when extended, will direct the discs to a storage bin positioned to the exterior of the cabinet or housing for the processor.

U.S. Pat. No. 6,760,052, shows a processor with a picker head that will pick up discs from a storage site or bin and will deposit them in a loading station of a printer and processor, and will also pick up discs from the loading station. The discs can be recorded and printed in sequential steps. After processing, the discs are picked up with the picker head and can be deposited in selected locations, including onto a slide that will cause the finished discs to slide forwardly out of the housing and drop into a storage bin.

SUMMARY OF THE INVENTION

A processor, which can include a CD or DVD burner, as well as a printer is provided with a sliding drawer that includes a bin or receptacle for receiving and storing compact discs that have been processed. The discs received by the storage drawer are finished or fully processed discs.

A slide drawer moves in and out (retractable and extendable) from a retracted location below the processors. It may be aligned with the loading (and unloading) stations for the processors. In the retracted position of the drawer, a pair of pivoting ramps are folded down and retained for storage. The bin for storing discs can be used with the drawer retracted. When it is desired to move the disc storage bin location on the storage drawer to the exterior of the cover for the processor, the storage drawer is moved out, and at the same time the spring loaded ramps, which have tapered ramp surfaces on their top, front ends, will pop up or move to an erect, working position. Any disc dropped onto the ramp surfaces by a disc picker will slide along the ramp surfaces into the storage bin.

When the sliding storage drawer is retracted, the ramps will be cammed to fold down as the disc storage drawer is moved in. The ramp moves about pivots mounting each ramp. An edge or a surface of the processor will engage a tapered cam surface on the pivoting ramps that will cause both of the ramps to pivot to their folded or stored position as the storage drawer is moved inwardly.

The storage drawer can be held in its retracted position in any desired manner, and usually friction loads on a support track for the drawer will be adequate to hold the storage drawer in place. The automatic unfolding or erect positioning of the ramps to their working position as the drawer is extended provides ready access for the disc slides which deposit the discs in a storage location outside of the cover for the housing.

DETAILED DESCRIPTION OF ILLUSTRATIVE EMBODIMENTS

Reference is made to U.S. Pat. No. 6,760,052 which is hereby incorporated by reference, for explanation of a processor with which the disc storage drawer of the present invention will operate. The disc storage drawer of the present disclosure be used in place of the sliding ramp shown in the center of the processor shown in U.S. Pat. No. 6,760,052.

Figure 1:
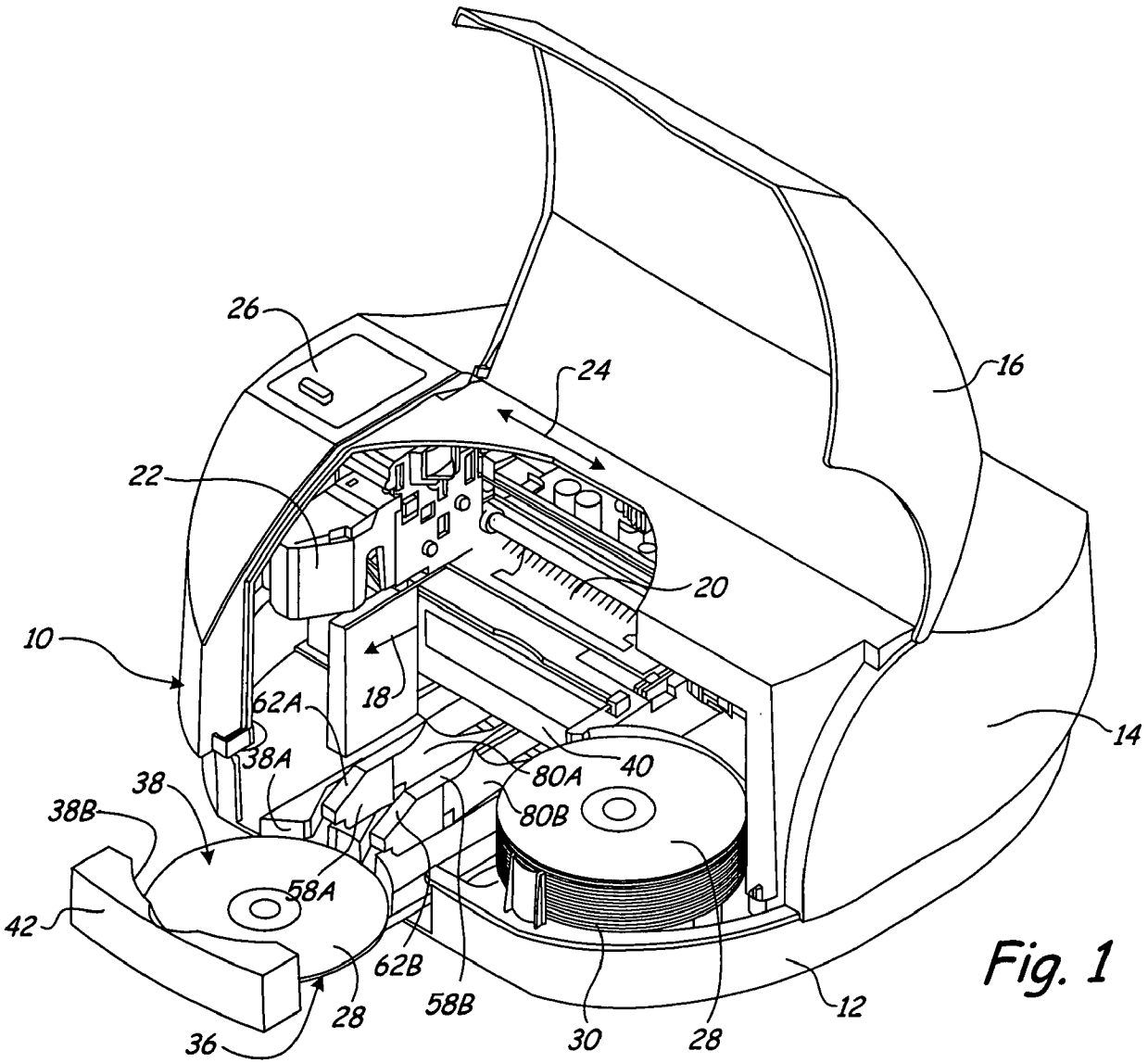
FIG. 1 is a front perspective view of a processor with a cover open to show processor elements, and with the disc storage drawer extended from a processor housing.

In FIG. 1, a processor assembly 10 includes a mounting base 12, and a housing 14. The housing 14 has a pivoting cover 16 at the front side of the housing. The processor includes a printer shown generally at 20, that has a printhead that moves laterally across the processor housing for printing on discs being processed, and a CD or DVD burner or processor 40 is mounted below the printer 20, as explained in U.S. Pat. No. 6,760,052. The printer and the processor or burner both have disc holders or supports that extend outwardly to a loading and unloading position as indicated by the arrow 18, to overlie a central area of the processor. In particular the disc supports are in a position so that discs carried by a picker head 22 of a disc handler arm can be placed on or removed from the processor disc supports. The picker head 22 is mounted on a track or rail to move laterally as indicated by the arrow 24 in a suitable manner. The picker head can be attached to the printhead, or moved with a separate drive.

The operations of the processor are controlled through suitable controls shown generally at 26, and programmed with software as desired for burning a CD or DVD, and printing a label directly on the CD or DVD in one processor housing.

Blank discs or substrates 28 are stacked in an unprocessed disc storage bin 30. The picker head 22 can be moved to pick up a single disc 28 and deposit it on the disc support for the printer or for the burner in a conventional manner. When a disc 28 is fully processed, that is, burned and also printed, the picker head 22 lifts the disc off the disc support for the processor and then, after the disc support for the processor is retracted, the picker head drops the finished disc onto a drawer assembly 36 that can be retracted as shown in FIG. 2 or in an extended position as shown in FIG. 1.

Figure 2:
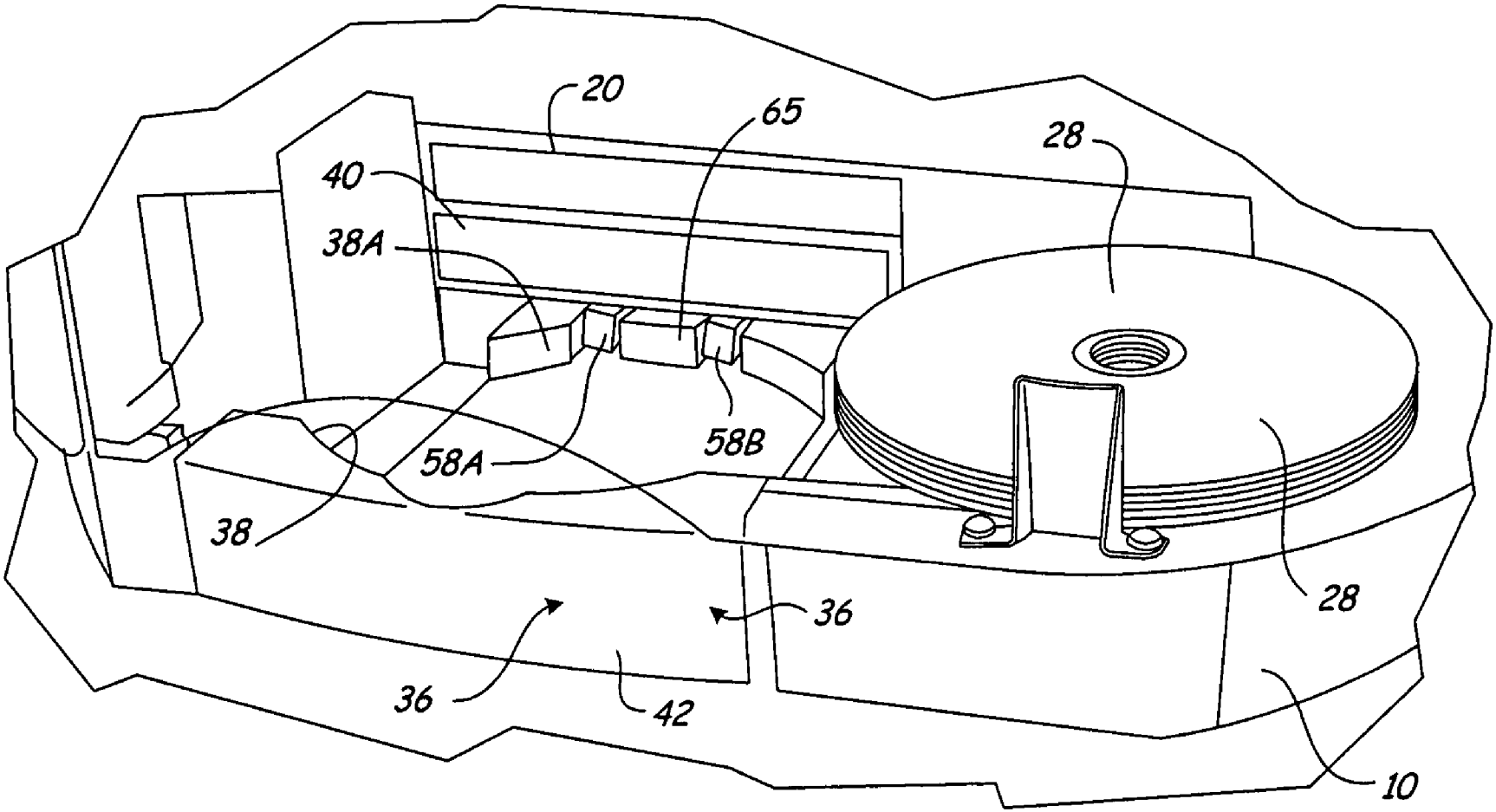
FIG. 2 is a fragmentary front perspective view of the processor of FIG. 1 with the cover closed, showing the disc storage drawer retracted to be inside the cover.
Figure 3:
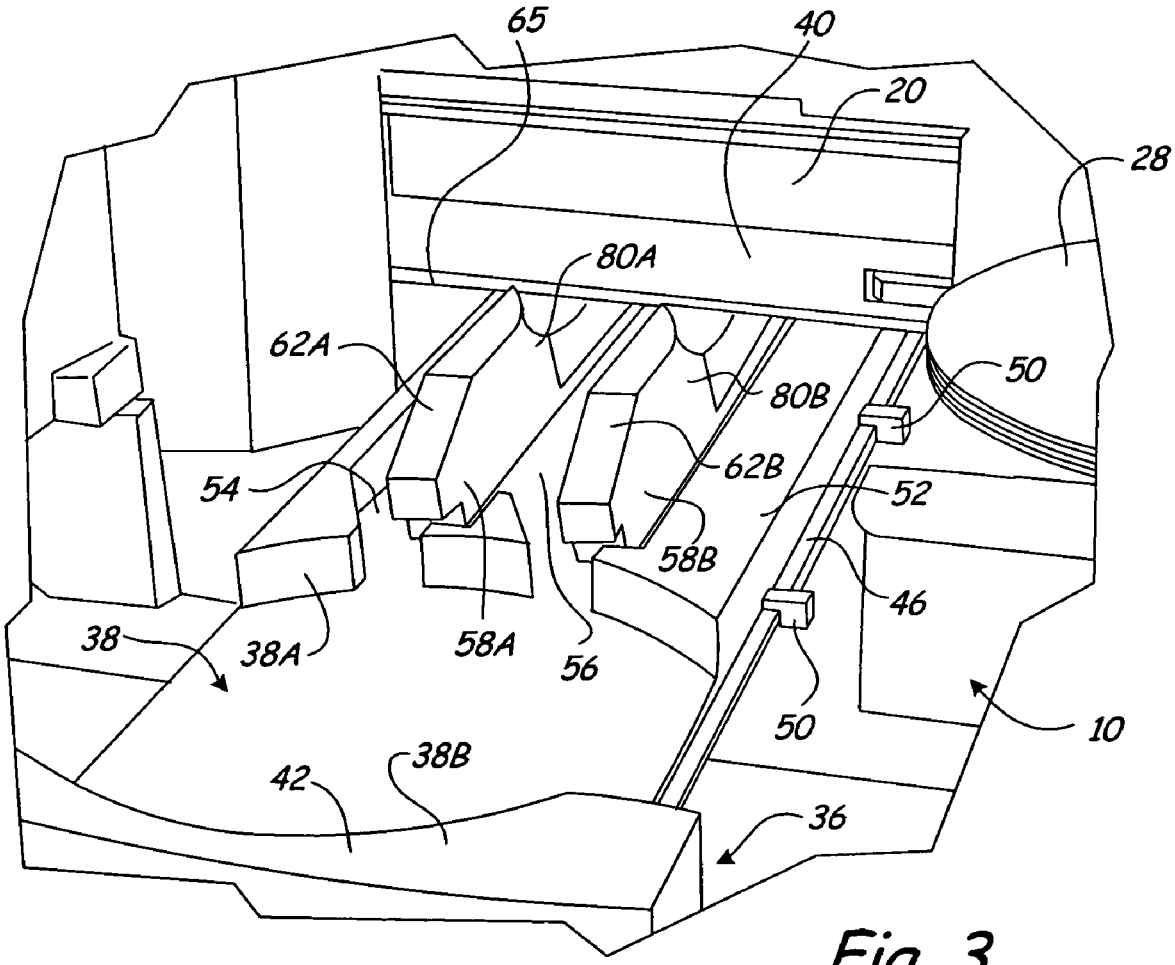
FIG. 3 is another fragmentary front perspective view of the processor in a working position with guide ramps on the disc storage drawer ramps in a position to transfer discs dropped thereon to the storage bin location.

The finished disc support sliding drawer assembly 36 is for receiving processed discs, and is movable between its first extended position as shown in FIG. 1, or to a second stored or retracted position shown in FIG. 2. A disc storage bin or hopper 38 on an outer end of the disc storage drawer 36 will be within the housing 12 in the retracted position of the disc storage drawer, so that the cover 16 can be closed as shown in FIG. 2. The disc storage bin 38 is then inside the housing 14 and finished discs can be dropped into the storage bin 38. The transparent cover 16 has a grab hole or opening 40 that permits lifting the cover and grasping the forward wall 42 of the disc storage drawer 36, to move the drawer in or out relative to the housing 14.

The disc storage bin 38 is formed by guide surfaces 38A at the rear portion or inner end of the storage bin and a guide surface 38B at the front wall 42 of the drawer. A disc 28 as shown will fit between these guide walls so finished discs can be stacked in the storage bin.

The storage drawer 36 has a pair of side rails or flanges 46, which are shown in FIGS. 7-11, that extend along a length of the disc storage drawer. The bottom surface of the disc storage drawer slides on a floor 48 of the processor housing 14 or it can be mounted on rails or guides.

Each side of the drawer 36 is guided with suitable guides 50 that are fastened to the floor 48 of processor housing 14 and which extends upwardly to overlap the side flanges 46 to stabilize the disc storage drawer 36 and permit it to be moved in and out between its extended and retracted positions.

Figure 7:
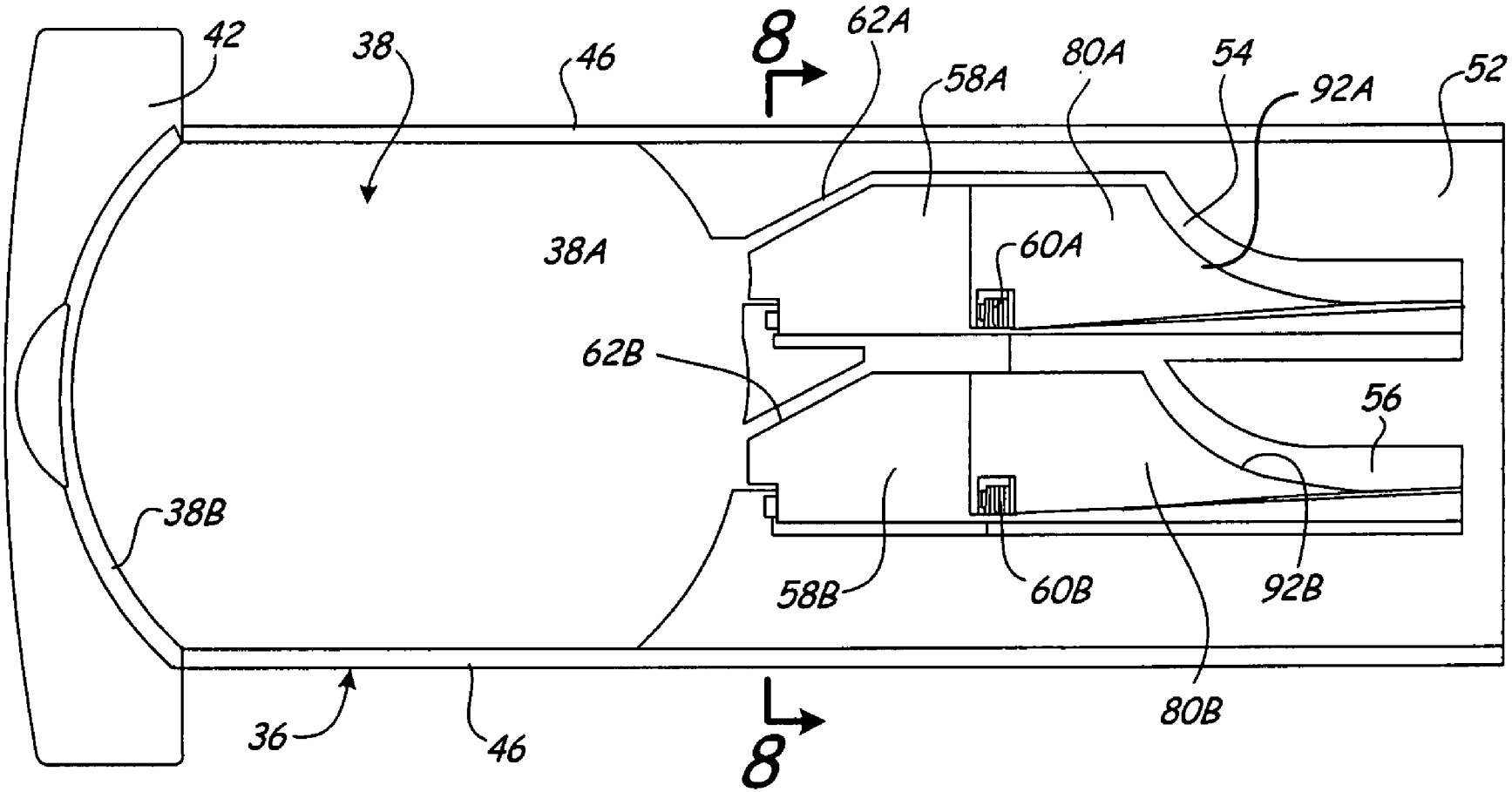
FIG. 7 is a top plan view of the disc storage drawer with the ramps in stored position.
Figure 8:
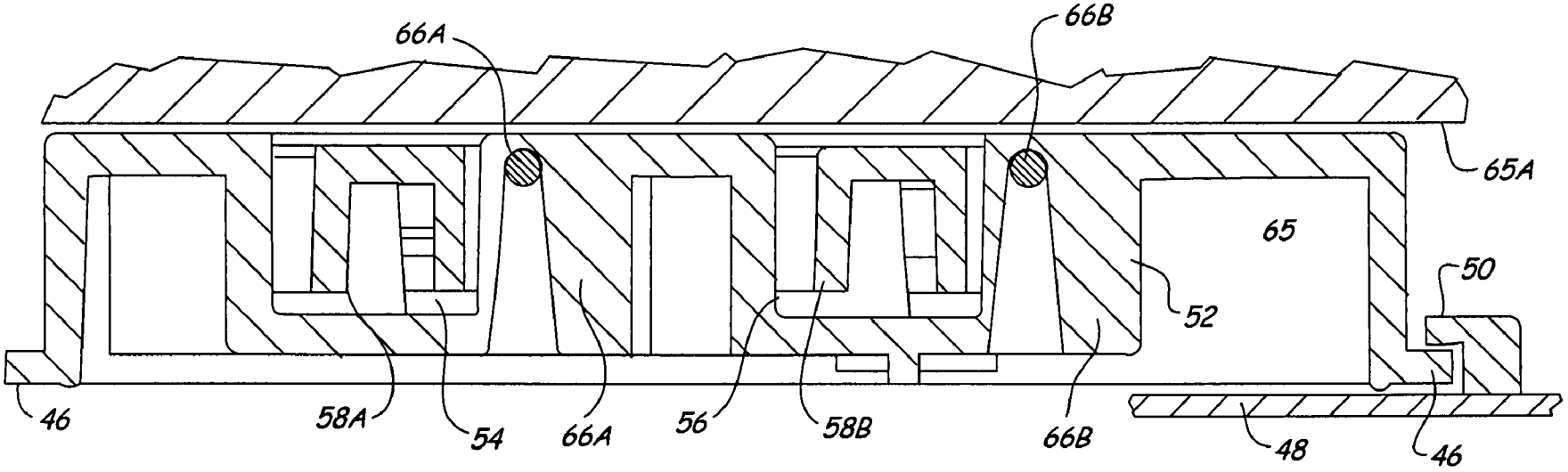
FIG. 8 is an enlarged sectional view taken on Line 8-8 of FIG. 7.

The inner or rear portion of the disc storage drawer 36 comprises a raised block section 52, which has recesses 54 and 56 formed therein. The recesses 54 and 56, each is of size and shape to receive one of a pair of pivoting ramps 58A and 58B, which are identical in construction. The ramps 58A and 58B will rest on their sides within the recesses 54 and 56, respectively when they are pivoted to a stored position as shown in FIGS. 7 and 8

The pair of ramps 58A and 58B have pivot pins that are pivotally mounted at the ends of the recesses 54 and 56 about fore and aft extending axes and are spring loaded into an upright position with suitable torsion springs 60A and 60B shown perhaps best in FIGS. 5, 6, 8 and 9. The torsion springs 60A and 60 are conventional torsion springs that act between the respective ramp and floor of the disc support drawer. The torsion springs will provide a biasing force to move the ramps from their folded stored position to an upright working position unless the ramps are held down. When the ramps are in the folded or stored position shown in FIG. 7, the torsion springs will be loaded or stressed. The ramps 58A and 58B are held in the stored position by an overlying wall or other guides on the processor when the disc support drawer 36 is slid to its retracted position beneath the processor. As shown in FIG. 2, with the disc support drawer retracted, the spring loaded ramps 58A and 58B will be engaging and held from popping up by a bottom wall 65 of the processor. The ramps 58A and 58B are held in that position against the force or action of the torsion springs 60A and 60B, which are tending to moving the ramps 58A and 58B to their erect or upright position.

The ramps 58A and 58B each have an inclined planar upwardly facing surface 62A and 62B, respectively, at their leading or outer ends and have planar top surfaces 64A and 64B.

Figure 11:
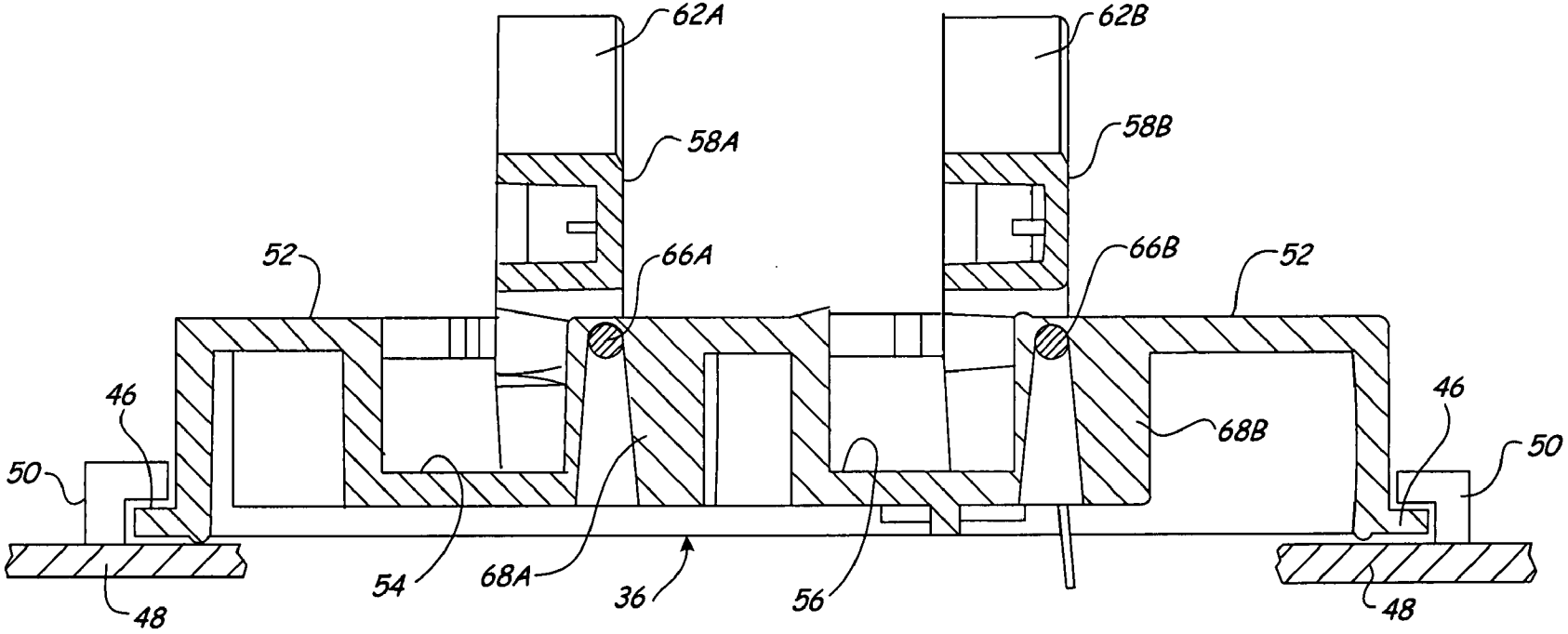
FIG. 11 is an enlarged sectional view taken on line 11-11 in FIG. 9.

The ramps 58A and 58B are pivotally mounted at their front and back ends for pivoting about fore and aft axes. The pivots may be pivot pins 66A, 66B, 70A and 70B that are fitted into bores or supports front and rear walls at the ends of the recesses 54 and 56 formed in the raised block 52. In FIGS. 8 and 11, the front pivot pins 66A and 66B on the ramps are shown. The pins 66A and 66B fit into bores of retaining recesses in portions 68A and 68B of the raised block 52 formed on the disc support drawer.

Figure 9:
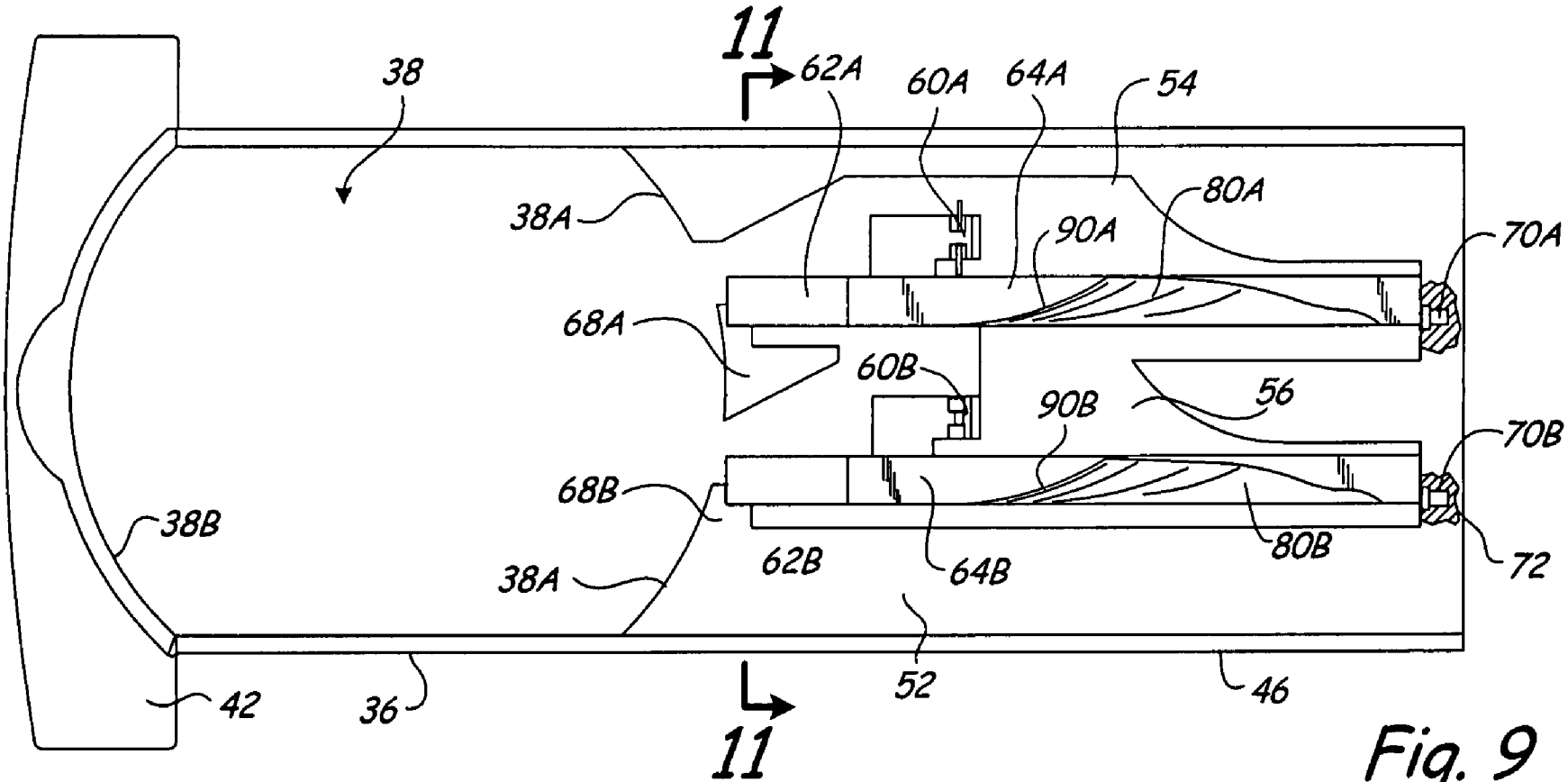
FIG. 9 is a top plan view of the disc storage drawer in position as shown in FIG. 5.
Figure 10:
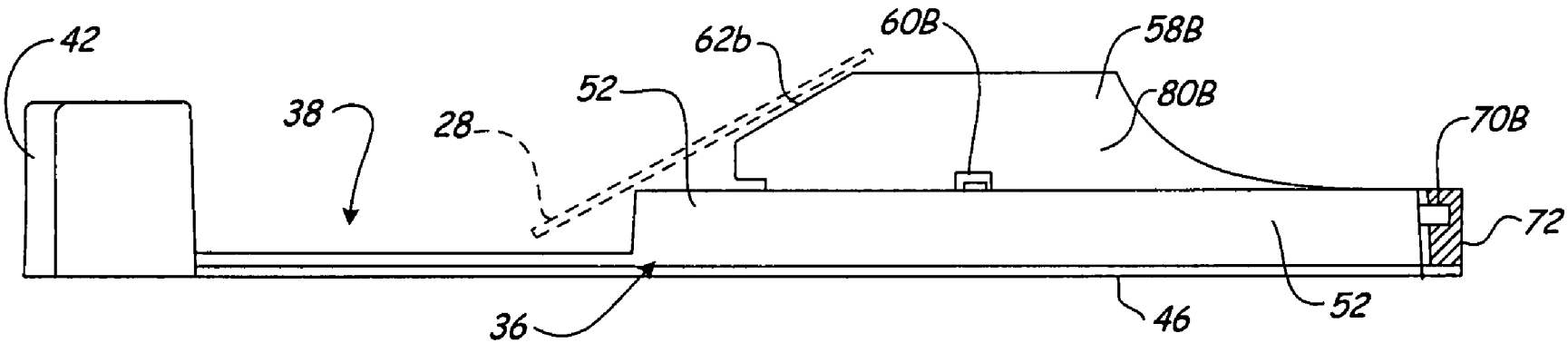
FIG. 10 is a side elevational view of the disc storage drawer of FIG. 9.

Rear pivot pins 70A and 70B for the ramps 58A and 58B are also shown in FIG. 9, and the pins 70A and 70B are rotatably mounted in suitable bores formed in the rear wall portions 72 of the disc support drawer.

In FIG. 2 the disc support drawer 36 is shown in its retracted position, as stated, and the ramps 58A and 58B are held down by the porcessor bottom wall 65, so that they are folded as shown in solid lines in FIGS. 7 and 8.

Figure 4:
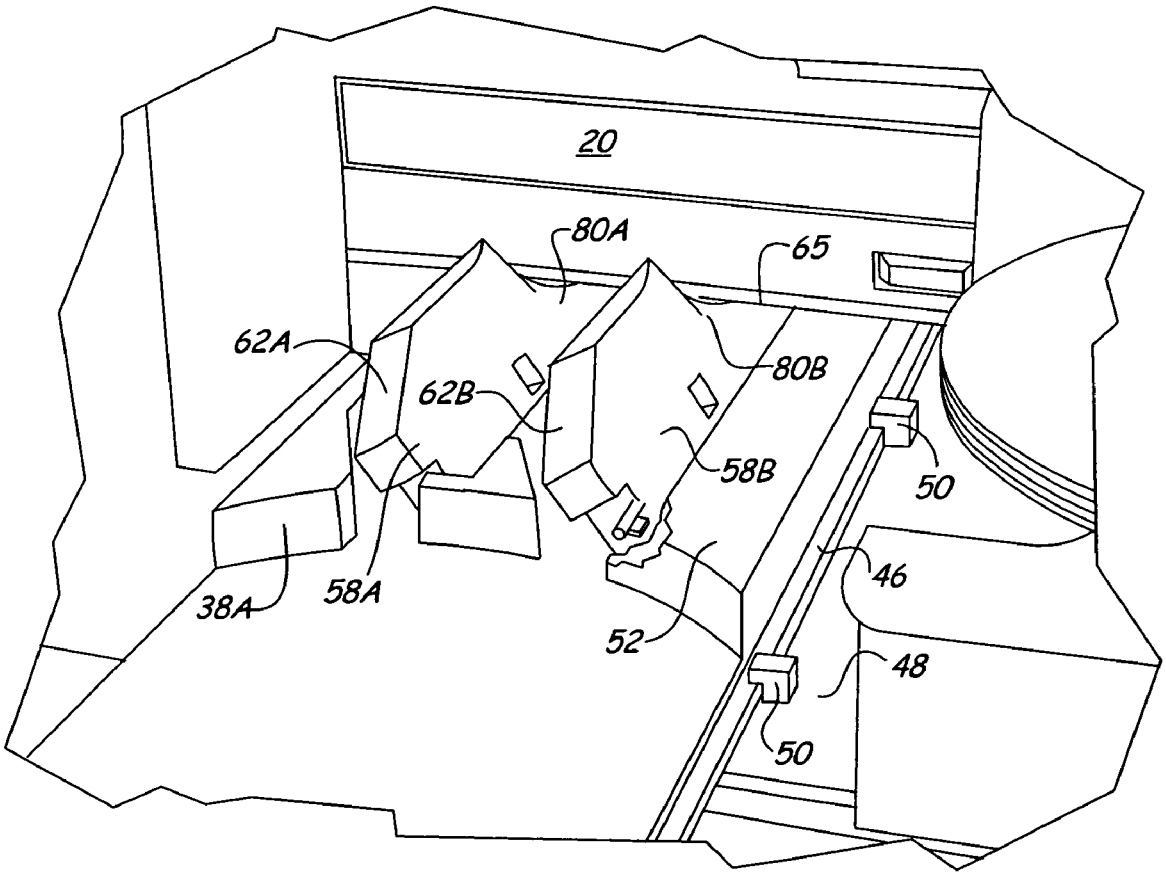
FIG. 4 is a fragmentary perspective view similar to FIG. 3 but with the disc storage drawer partially retracted to show the camming action for pivoting the ramps between their working position and their stored position.
Figure 5:
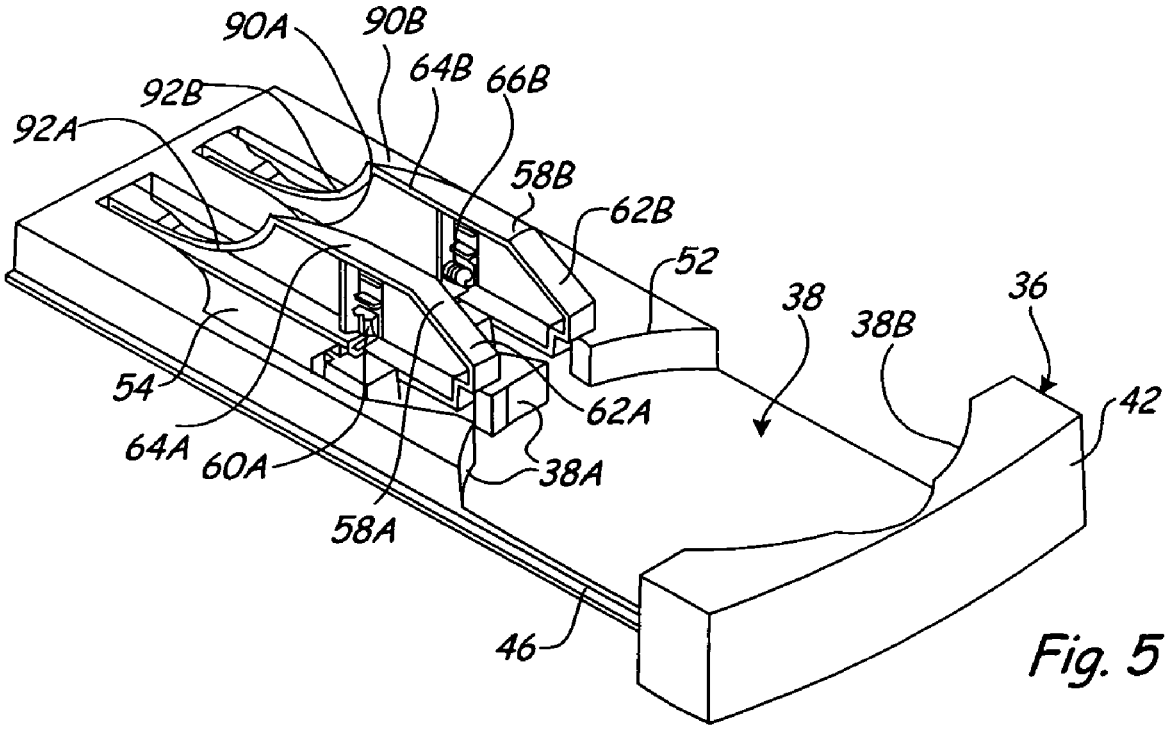
FIG. 5 is a perspective view of the disc storage drawer removed from the processor with the ramps in their working position.
Figure 6:
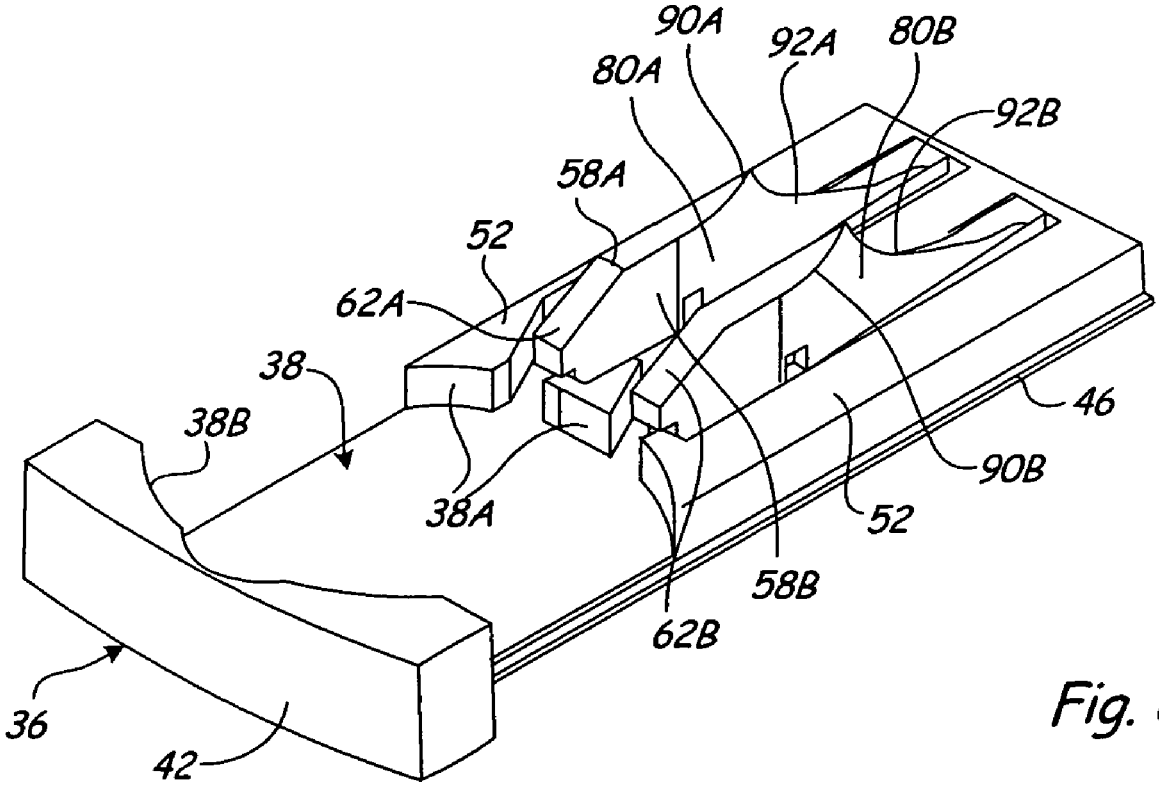
FIG. 6 is a perspective view of the disc storage drawer from the opposite side from FIG. 5 with the ramps in the position shown in FIG. 5.

The ramps 58A and 58B will be retained in their folded or stored position until the disc support drawer 36 is pulled outwardly. FIG. 4 shows the disc support drawer 36 partially extended. The flat top surfaces 64A and 64B of the ramps extend rearwardly a desired amount, and the ramps then have sidewardly and upwardly facing cam surfaces formed into by generally helical side surface portions 80A and 80B, also shown in FIG. 4. These cam surfaces are curved laterally (sideways) in fore and aft direction, as seen at 90A and 90B in FIGS. 5, 6 and 9, and also curved in vertical direction along the lengths of the ramps as shown at 92A and 92B in FIGS. 5, 6, and 7. The partially extended disc support drawer 36 in FIG. 4 shows that as the disc support drawer 36 is pulled out, the front edge corner of the bottom wall 65 of the processor will ride against these ramp-type helical surfaces, and the ramps will spring to an upright position under the urging of the torsion springs 60A and 60B.

FIG. 4 also can be considered as showing a position when the disc support drawer is moved inwardly, and the cam surfaces 80A and 80B are formed to provide a curved cam surface that will not bind, as the disc support drawer 36 is pushed in. The camming action as the drawer is moved in will cause the ramps 58A and 58B to pivot about their pivot pins to their folded or non-working position where they are folded to the side into the respective recess 54 or 56 and held under a bottom surface 65A of the wall 65 of the processor. Schematically the bottom wall 65 and bottom surface 65A are shown in FIG. 8. The helical surfaces 80A and 80B will be termed a cam or guide surfaces, and they are configured to provide for the necessary rotational torque to overcome the spring force of the torsion springs 60A and 60B when the disc support drawer 36 is pushed into its retracted position.

The disc storage bin 38 of disc support drawer 36 is available for use when the cover 14 of the housing is open or closed. Pulling the disc support drawer 36 outwardly provides a way of depositing discs on the exterior of the housing 14 by dropping them so they engage the inclined surfaces 62A and 62B and slide down the retractable ramps (See FIG. 10). The disc support drawer 36 is retractable when the processor is not in use or when the disc storage bin 38 to be used within the perimeter of the housing.

The disc support drawer 36, as shown, is manually operated but it could be operated by a drive motor, with an actuator arrangement, or could be spring loaded into the closed position and latched in the open position, or vice versa.

The disc support drawer 36 will slide in underneath processor, with very little increase in height over the base of the housing, as shown, and is shown for use with many different types of disc manipulators or disc handlers.

The disc support drawer 36 can be molded or manufactured in any desired way. The side flanges 46 and the guides 50 form tracks, and they can be reversed in position, that is, guides can be provided on the disc support drawer and tracks can be on the housing bottom wall 48. Full length tracks can be provided. The length and angle of the inclined ramp surfaces 62A and 62B can be changed to accommodate existing conditions.

Although the present invention has been described with reference to preferred embodiments, workers skilled in the art will recognize that changes may be made in form and detail without departing from the spirit and scope of the invention.

What is claimed is:

1. A processor for substrates that includes a housing having a lower wall surface, a processor mounted in the housing for processing substrates and having a portion spaced from the lower wall surface, a drawer slidably supported on said housing and having a portion in a space between the lower wall surface and the portion of the processor, the drawer including at least one ramp member pivotally mounted about an axis parallel to a direction of sliding movement of the drawer, the ramp member being pivotal from a first folded position wherein a side of the ramp member is adjacent a bottom of the drawer, to a second position wherein the ramp member is generally upright, the ramp member having a tapered surface for guiding substrates dropped on an upper side of the ramp member, and a camming surface on the ramp member engaging a portion of the processor when the drawer is moved from an extended position to a drawer retracted position, the camming surface acting to pivot the ramp member about its axis to the first folded position with the ramp member below the processor.

2. The processor of claim 1 wherein the ramp member comprises a pair of side by side ramp members, pivotally mounted about parallel axes and each ramp member having a camming surface for engaging a portion of the processor to move the pair of ramp members to folded positions as the drawer is moved inwardly relative to the processor.

3. The processor of claim 2 wherein said tapered surfaces of the ramp members have substantially planar surfaces positioned at an angle relative to the bottom of the drawer to provide a surface for slidably guiding a substrate dropped thereon.

4. The processor of claim 1 wherein said drawer has a substrate receiving bin portion positioned adjacent the tapered surface of the ramp member such that a substrate sliding along the tapered surface of the ramp member will slide into the substrate receiving bin portion.

5. The processor of claim 1 wherein said substrates comprise discs.

6. The processor of claim 5 wherein said discs comprise one of CDs, DVDs, and recordable discs.

7. A disc processor for processing compact discs comprising a slidably mounted drawer having a first section forming a storage bin for receiving discs, and a second section, at least one ramp member pivotally mounted on the second section of said drawer and in alignment with the storage bin, said ramp member being pivotally mounted about an axis extending in direction of a longitudinal axis of the drawer, and foldable about the axis from a folded position wherein a side surface of the ramp member is adjacent a bottom of the drawer, and a second position wherein the ramp member is upright to present at least a portion of an inclined surface on the ramp member inclining from an upper side of the ramp member toward the storage bin, and said ramp member having a tapered surface extending toward an end opposite from the inclined surface and the storage bin, said tapered surface comprising a camming surface; the disc processor having a recess for receiving the drawer, and the camming surface engaging at least a portion of the processor when the drawer is moved inwardly into the recess, which will cause the ramp member to pivot about the axis to the folded position.

8. The disc processor of claim 7, and a biasing member acting between the bottom of the drawer and the ramp member urging the ramp member to the second position.

9. The disc processor of claim 7 wherein said camming surface is a compound surface that has an edge curved from a low point at a rear portion of the ramp member upwardly to an upper side of the ramp member in mid portions of the ramp member, and a curved edge in plan view along the upper side of the ramp member, and being convex in a lateral direction from an upper point of the curved edge along a side surface toward an opposite side surface.

10. The disc processor of claim 7 wherein said processor has a housing, and in a retracted position the drawer is in a recess below the processor and the storage bin on the drawer is within the housing, and in an extended position of the drawer with the ramp member pivoted to the second position the storage bin is on an exterior of the housing.

11. The disc processor of claim 10 and further comprising guides along sides of the drawer for guiding the drawer between extended and retracted positions.

* * * * *